US010998682B2

(12) United States Patent
Ito

(10) Patent No.: US 10,998,682 B2
(45) Date of Patent: May 4, 2021

(54) CONNECTOR

(71) Applicant: Sumitomo Wiring Systems, Ltd., Yokkaichi (JP)

(72) Inventor: Yui Ito, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/788,699

(22) Filed: Feb. 12, 2020

(65) Prior Publication Data

US 2020/0266586 A1 Aug. 20, 2020

(30) Foreign Application Priority Data

Feb. 15, 2019 (JP) ..... JP2019-025713

(51) Int. Cl.
*H01R 13/66* (2006.01)
*H01R 13/502* (2006.01)
*H01R 13/405* (2006.01)

(52) U.S. Cl.
CPC ..... *H01R 13/665* (2013.01); *H01R 13/405* (2013.01); *H01R 13/502* (2013.01)

(58) Field of Classification Search
CPC ... H01R 13/665; H01R 13/405; H01R 13/502
See application file for complete search history.

(56) References Cited

U.S. PATENT DOCUMENTS

2020/0083634 A1* 3/2020 Ito ..... H01R 13/514
2020/0266586 A1* 8/2020 Ito ..... H01R 13/405
2020/0266598 A1* 8/2020 Ito ..... H05K 3/328

FOREIGN PATENT DOCUMENTS

JP 2012-099274 5/2012
JP 2012099274 A * 5/2012

* cited by examiner

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A connector (1) forms an internal space (13) for accommodating a circuit board (12) and a case (11). The connector (1) includes first terminals (2), a first core (5), second terminals, a second core, a housing (8) and a ventilation path (14). The first core (5) holds the first terminals (2) while exposing both ends. The second core faces and overlaps the first core (5). The second core holds the second terminals while exposing both ends. The housing (8) covers at least parts of the first and second cores. The ventilation path (14) allows the internal space (13) to communicate with outside air. At least a part of the ventilation path (14) is constituted by a groove portion (512) in at least one of overlapping surfaces of the first and second cores (5) overlapping each other. The groove portion (512) has a bent shape in the overlapping surface.

7 Claims, 18 Drawing Sheets

CONNECTOR

BACKGROUND

Field of the Invention

This disclosure relates to a connector.

Related Art

Japanese Unexamined Patent Publication No. 2012-99274 discloses a device connector mounted on a wall of a case accommodating a circuit board. The device connector is formed with a vent allowing communication between the inside and outside of the case to suppress a pressure increase in the case due to heat generation of the circuit board.

The vent in the connector housing of the device connector can be formed by arranging a pin in a mold for the connector housing and removing the pin after the connector housing is molded. However, the pin is elongated, and the vent may not be formed well, such as due to breakage of the pin during molding of the connector housing.

Accordingly, the device connector of Japanese Unexamined Patent Publication No. 2012-99274 has two primary molded bodies for holding terminal fittings and the connector housing is insert-molded using the two primary molded bodies as cores. The vent is formed by overlapping the two primary molded bodies. Specifically, a groove is formed in a mating surface of one primary molded body and the two primary molded bodies are overlapped to cover an opening side of the groove by a mating surface of the other primary molded body. The vent is formed inside the groove.

The groove of the device connector described in Japanese Unexamined Patent Publication No. 2012-99274 is formed over two mating surfaces perpendicular and adjacent to each other in the primary molded bodies. Thus, parts of the groove formed in the respective flat mating surfaces in the primary molded bodies are straight.

However, depending on the arrangement and shapes of first and second terminals and the like formed in first and second cores, it may not be possible to form the groove for the vent straight in the flat mating surfaces. That is, the groove may interfere with the first and second terminals and may be difficult to form.

This disclosure was developed in view of such a problem and aims to provide a connector in which a properly configured groove is formed easily.

SUMMARY

One aspect of the disclosure is directed to a connector forming an internal space for accommodating a circuit board together with a case. The connector includes first terminals, a first core holding the first terminals while exposing both ends of the first terminals, second terminals and a second core facing and overlapping the first core. The second core holds the second terminals while exposing both ends of the second terminals. A housing covers at least a part of the first core and at least a part of the second core. A ventilation path allows the internal space to communicate with outside air. At least a part of the ventilation path is constituted by a groove formed in at least one of overlapping surfaces of the first and second cores. The groove has a bent shape in the overlapping surface. A straight groove might interfere with the first terminals formed in the first core and/or the second terminals formed in the second core. However, the bent shape enables the groove to avoid interfering with the first terminals, the second terminals and the like. Thus, it is possible to provide a connector in which a properly configured groove is formed easily.

DETAILED DESCRIPTION

First Embodiment

Figure 1:
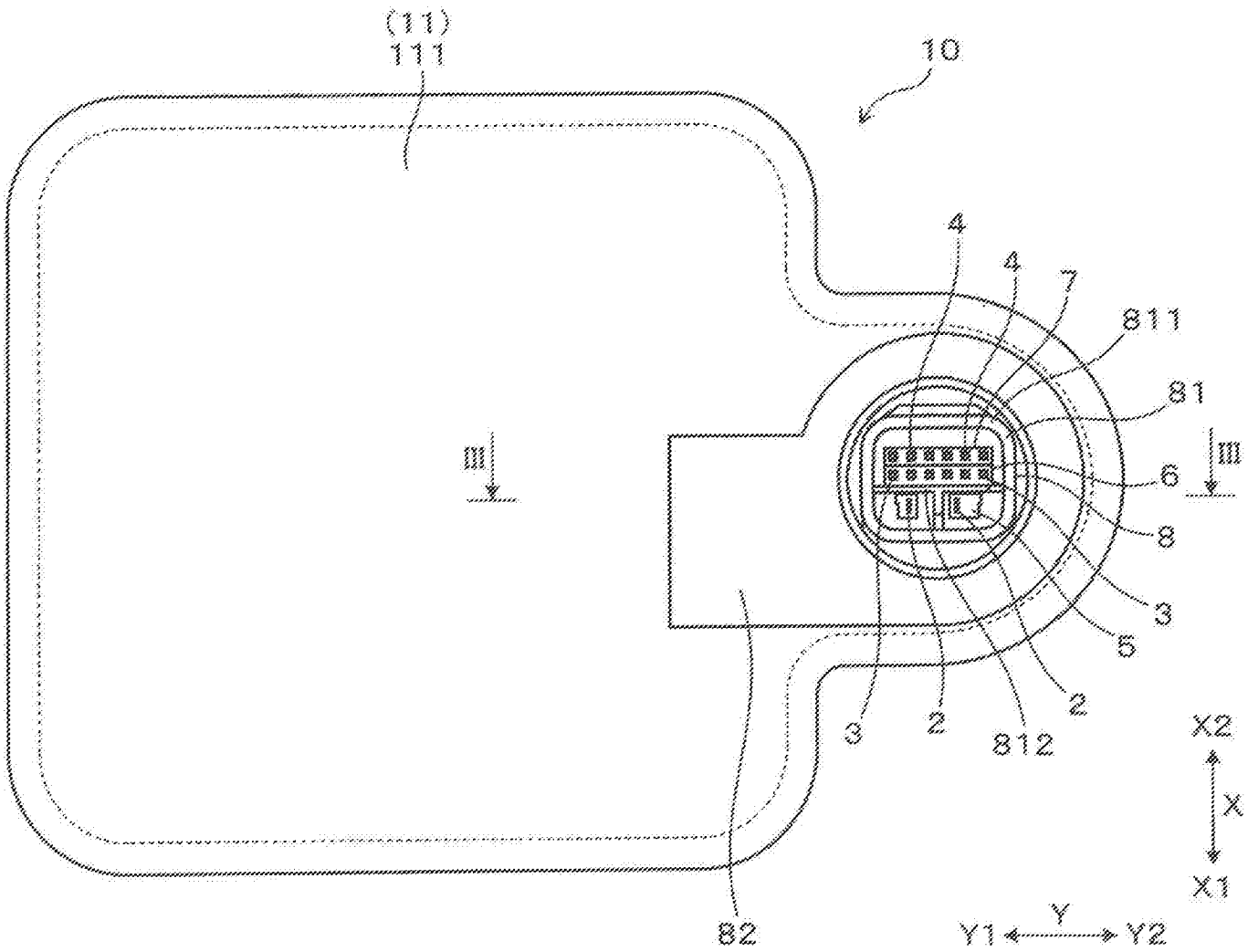
FIG. 1 is a plan view of a control device with a connector in a first embodiment.

A first embodiment of a connector is described using FIGS. 1 to 14. A connector 1 of this embodiment forms an internal space 13 for accommodating a circuit board 12 together with a case 11, as shown in FIG. 3. The connector 1 includes first terminals 2, a first core 5, second terminals 3, a second core 6, a housing 8 and a ventilation passage 14.

Figure 5:
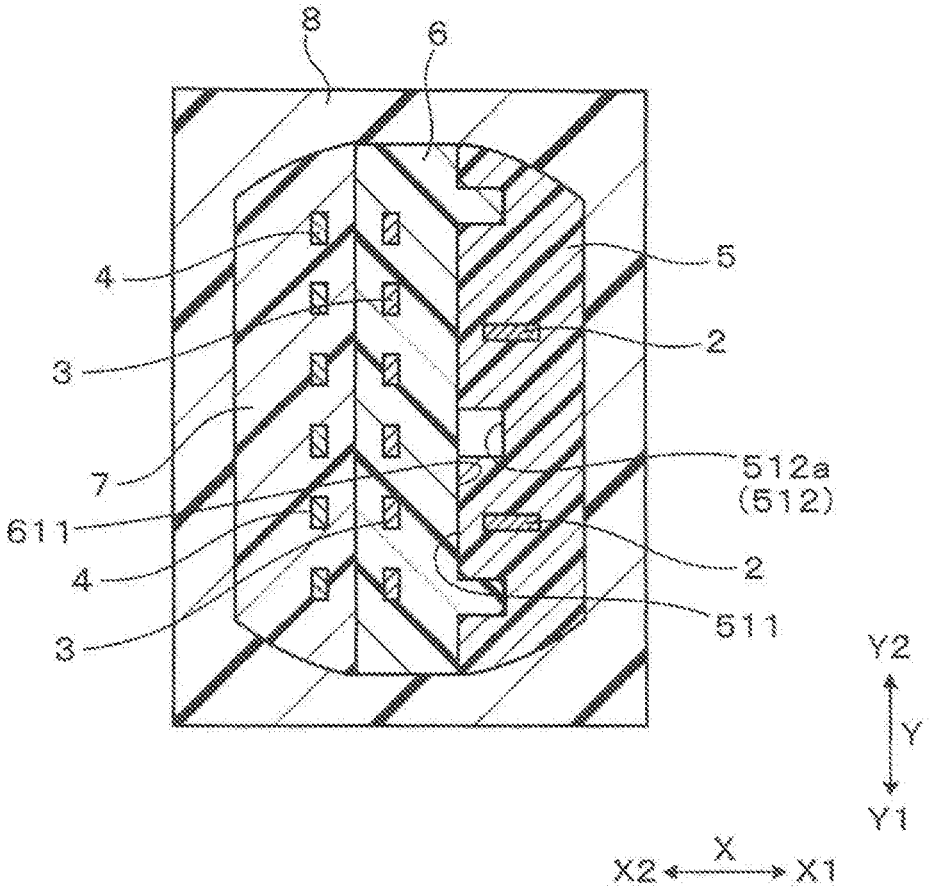
FIG. 5 is a section along V-V of FIG. 2.
Figure 6:
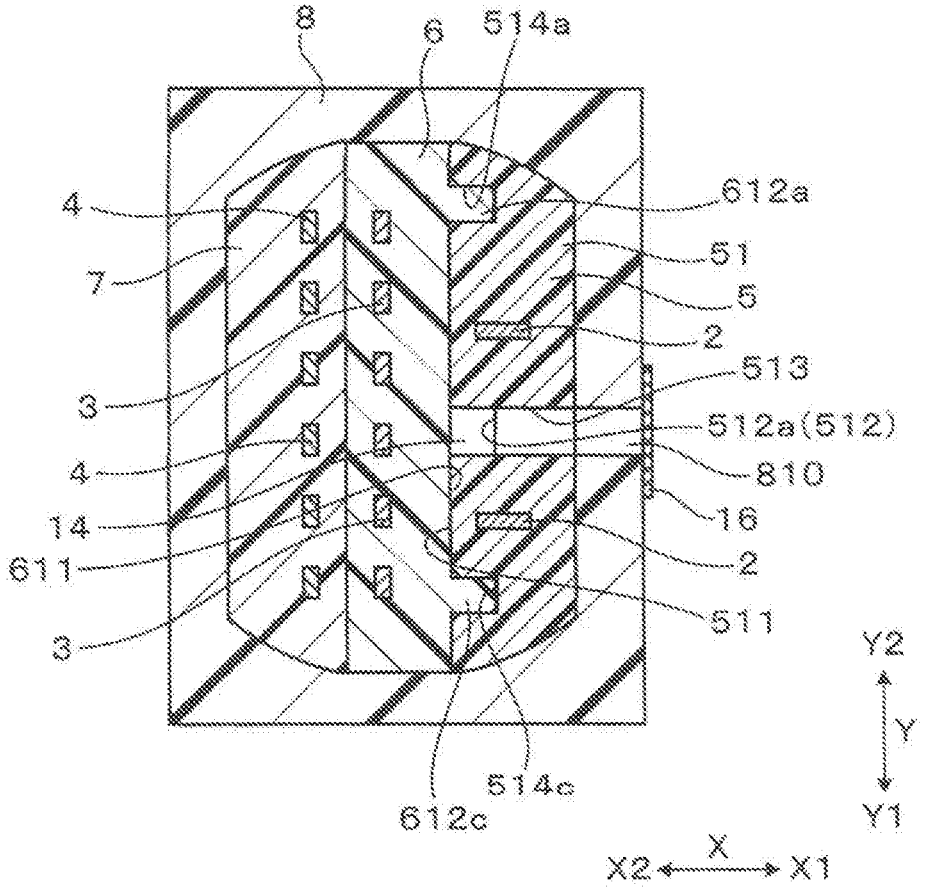
FIG. 6 is a section along VI-VI of FIG. 2.
Figure 7:
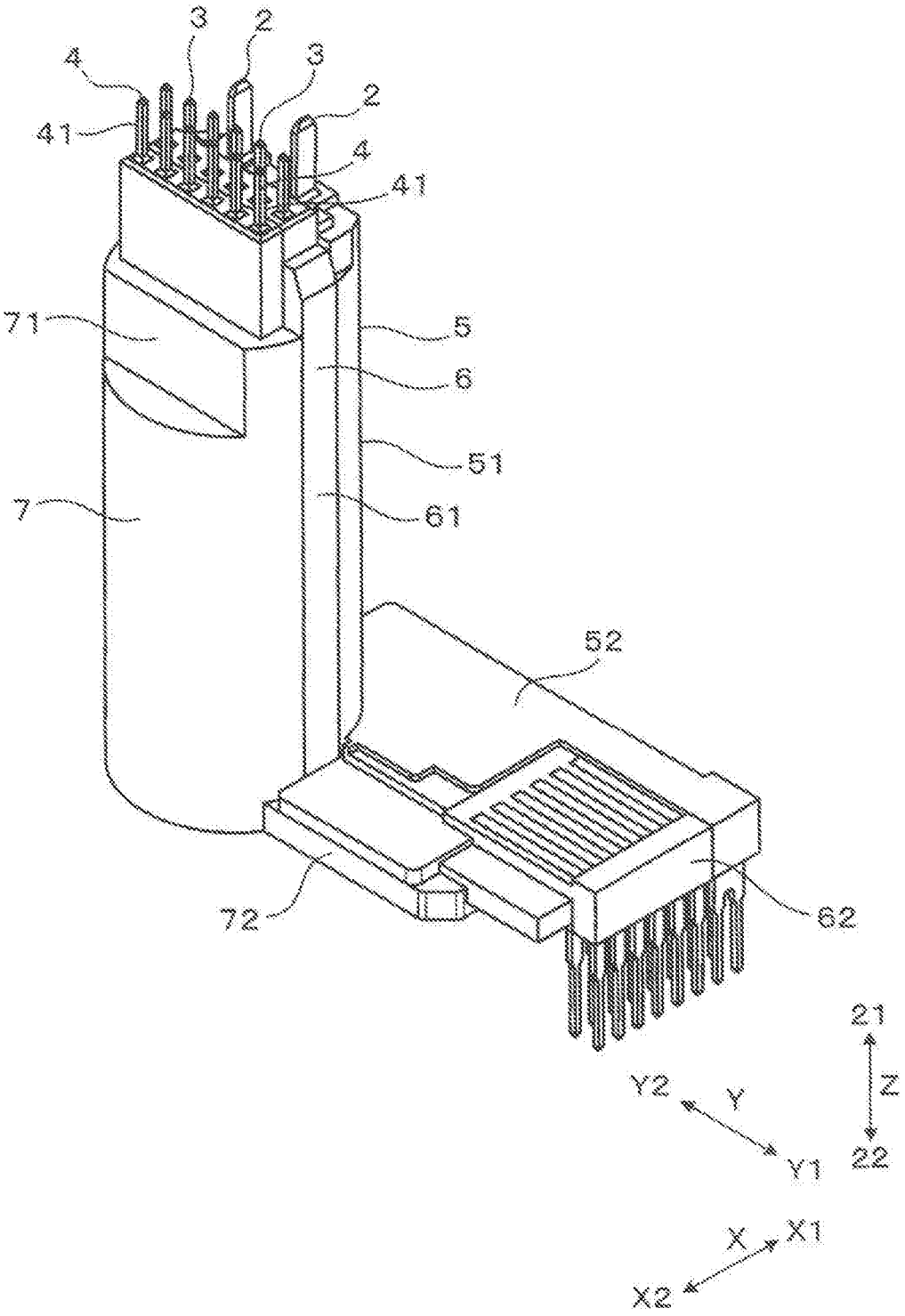
FIG. 7 is a perspective view of first terminals, a first core, second terminals, a second core, third terminals and a third core in the first embodiment.
Figure 8:
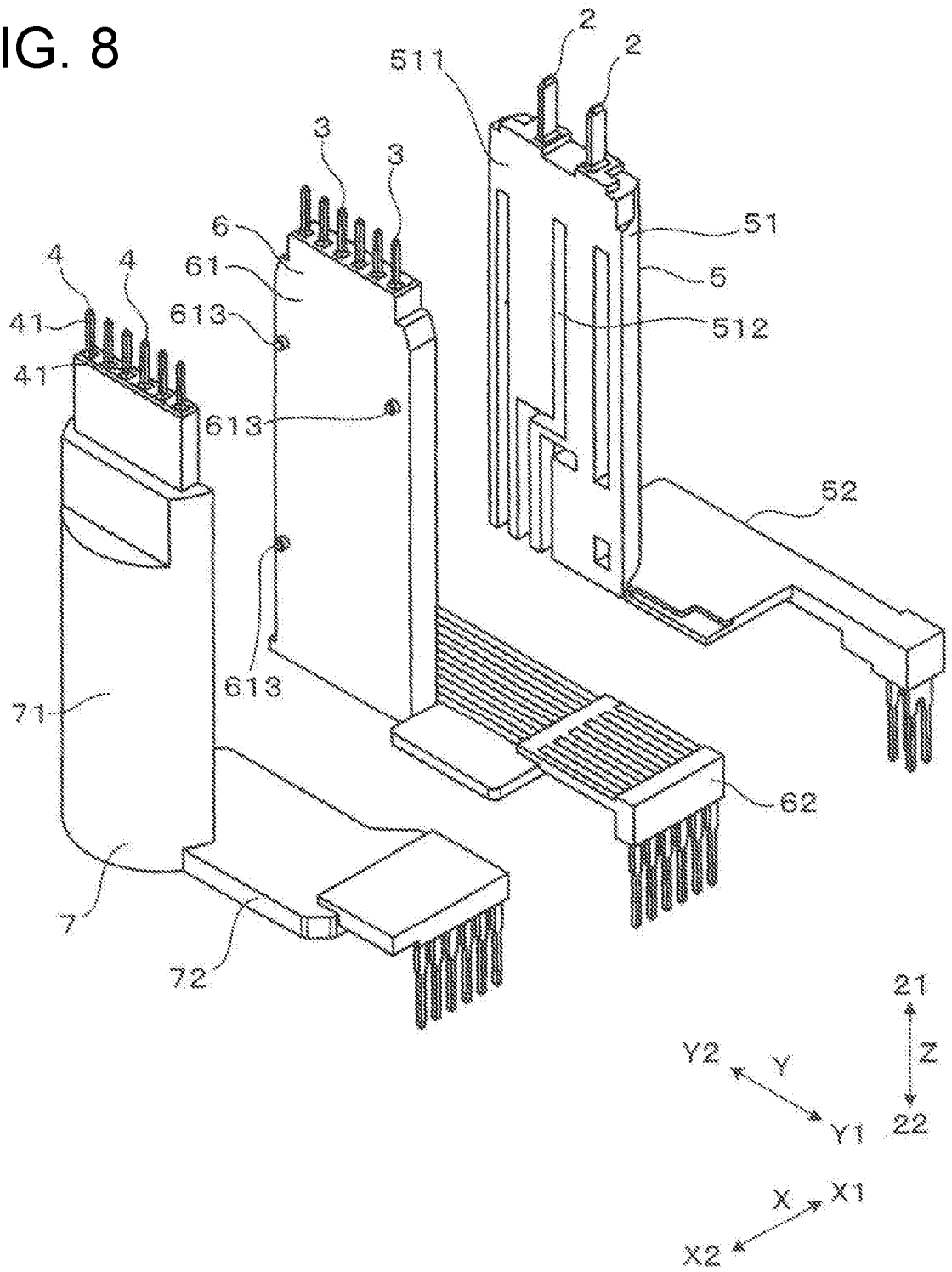
FIG. 8 is an exploded perspective view of the first terminals and the first core, the second terminals and the second core, and the third terminals and the third core of FIG. 7.

As shown in FIGS. 7 and 8, the first core 5 holds the first terminals 2 while exposing both ends of the first terminals 2. The second core 6 faces and overlaps the first core 5. The second core 6 holds the second terminals 3 while exposing both end parts of the second terminals 3. As shown in FIGS. 3, 5 and 6, the housing 8 covers at least a part of the first core 5 and at least a part of the second core 6.

As shown in FIG. 3, the ventilation path 14 allows the internal space 13 of the case 1 to communicate with outside air. As shown in FIGS. 3 to 6, at least a part of the ventilation path 14 is constituted by a groove 512 formed in at least one of overlapping surfaces of the first and second cores 5, 6 overlapping each other. As shown in FIGS. 3 and 4, the groove 512 has a bent shape in the overlapping surface.

(Connector 1)

As shown in FIG. 3, the connector 1 can be used for the control device 10 with the circuit board 12 for controlling the operation of an in-vehicle device, such as an automatic transmission. The circuit board 12 is accommodated in the box-like case 11 and is configured to generate heat by energization. The connector 1 of this embodiment can be used for electrically connecting the circuit board 12 in the case 11 and an electrical device outside the case 11.

As shown in FIG. 1, the connector 1 includes two first terminals 2, six second terminals 3 and six third terminals 4. Each of the first, second and third terminals 2, 3 and 4 has a conductor pin, and the connector 1 is a so-called male connector. As shown in FIG. 3, a mating connector 191 to be connected to the connector 1 is a so-called female connector. The second terminals 2 are for power supply and the second and third terminals 3, 4 are control terminals in this embodiment. However, there is no limitation to this.

[First Core 5]

Figure 9:
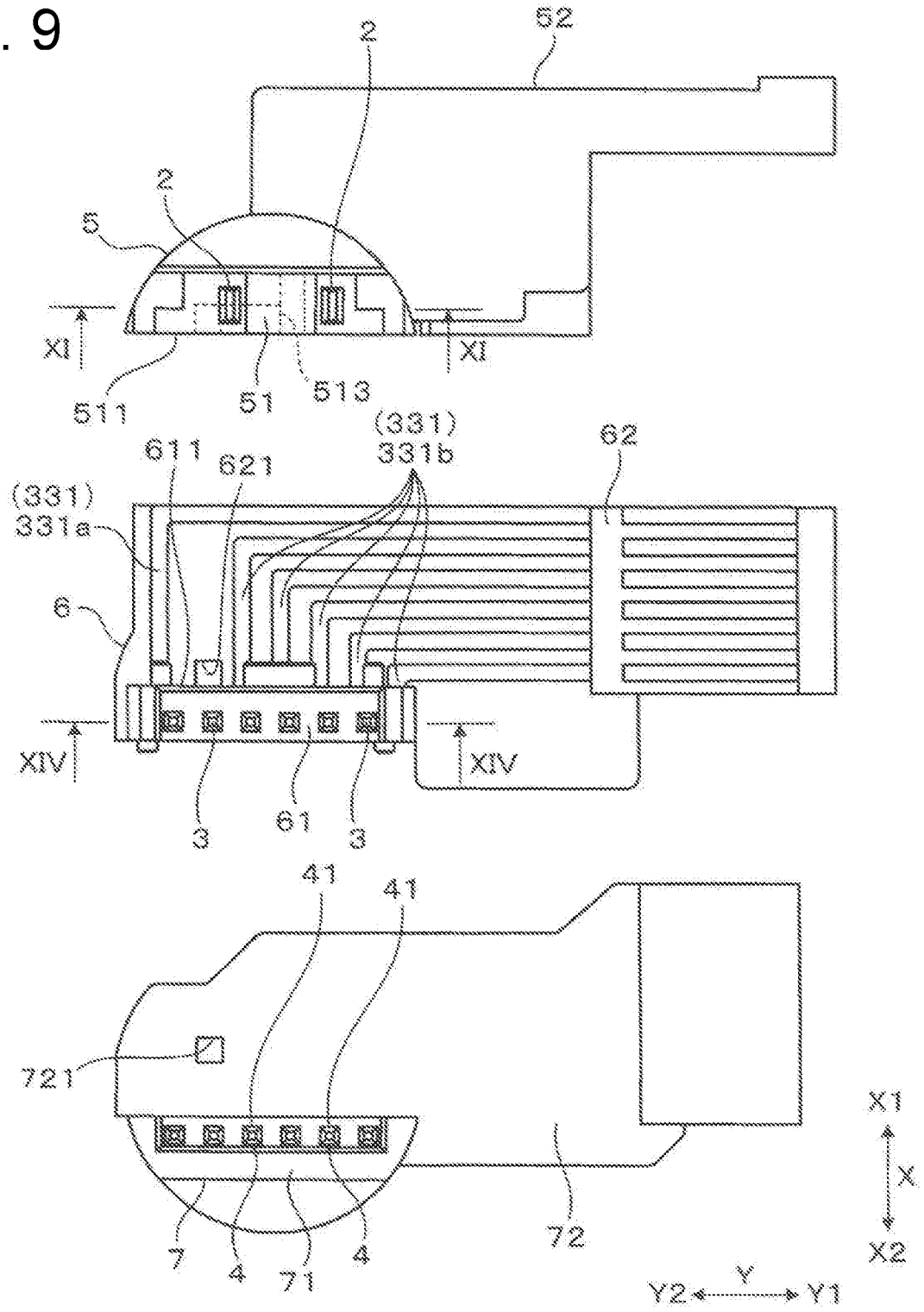
FIG. 9 is an exploded plan view of the first terminals and the first core, the second terminals and the second core, and the third terminals and the third core of FIGS. 7 and 8.
Figure 10:
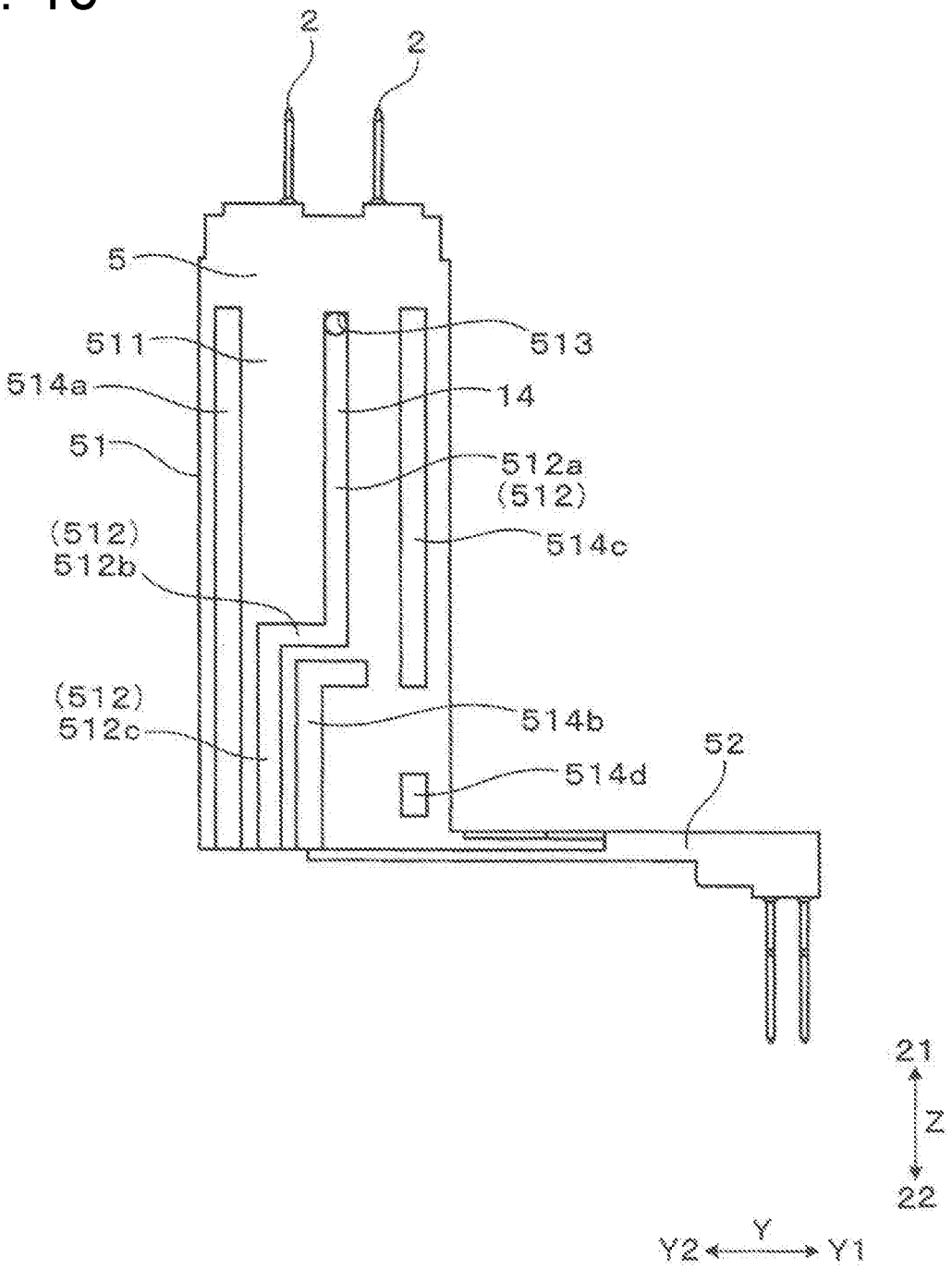
FIG. 10 is a view of the first terminals and the first core viewed from the side of the second core in the first embodiment.

As shown in FIGS. 8 to 10, the first core 5 holds the two first terminals 2 such that the first terminals 2 are parallel. The first terminals 2 are disposed at a predetermined interval that is maintained by the first core 5.

The first core 5 includes a first base 52 formed in a plane direction parallel to the circuit board 12 and a first tower 51 projecting from the first base 52 toward a side opposite to the internal space 13 of the case 11 in a normal direction to the circuit board 12 (hereinafter, referred to as a "Z direction"). A side in the Z direction toward which the first tower 51 projects from the first base 52 is referred to as a Z1 side, and an opposite side thereof is referred to as a Z2 side.

The first tower 51 has a thickness in an X direction perpendicular to the Z direction. As shown in FIGS. 8 and 9, an overlapping surface to be overlapped on a later-described second tower 61 of the second core 6 is formed on a surface of the first tower 51 on one side in the X direction. The surface of the first tower 51 to be overlapped on the second tower 61 is referred to as a first overlapping surface 511, and a surface of the second tower 61 to be overlapped on the first overlapping surface 511 of the first tower 51 is referred to as a second overlapping surface 611. One side in the X direction where the second tower 61 is located with respect to the first tower 51 is referred to as an X2 side and an opposite side thereof is referred to as an X1 side.

The first overlapping surface 511 is perpendicular to the X direction. As shown in FIG. 10, the first overlapping surface 511 of the first tower 51 is formed with a tower groove constituting the aforementioned groove 512. The tower groove constitutes at least a part of the ventilation path 14. In this embodiment, the groove 512 is constituted only by the tower groove and is referred to as the tower groove 512 below.

Figure 11:
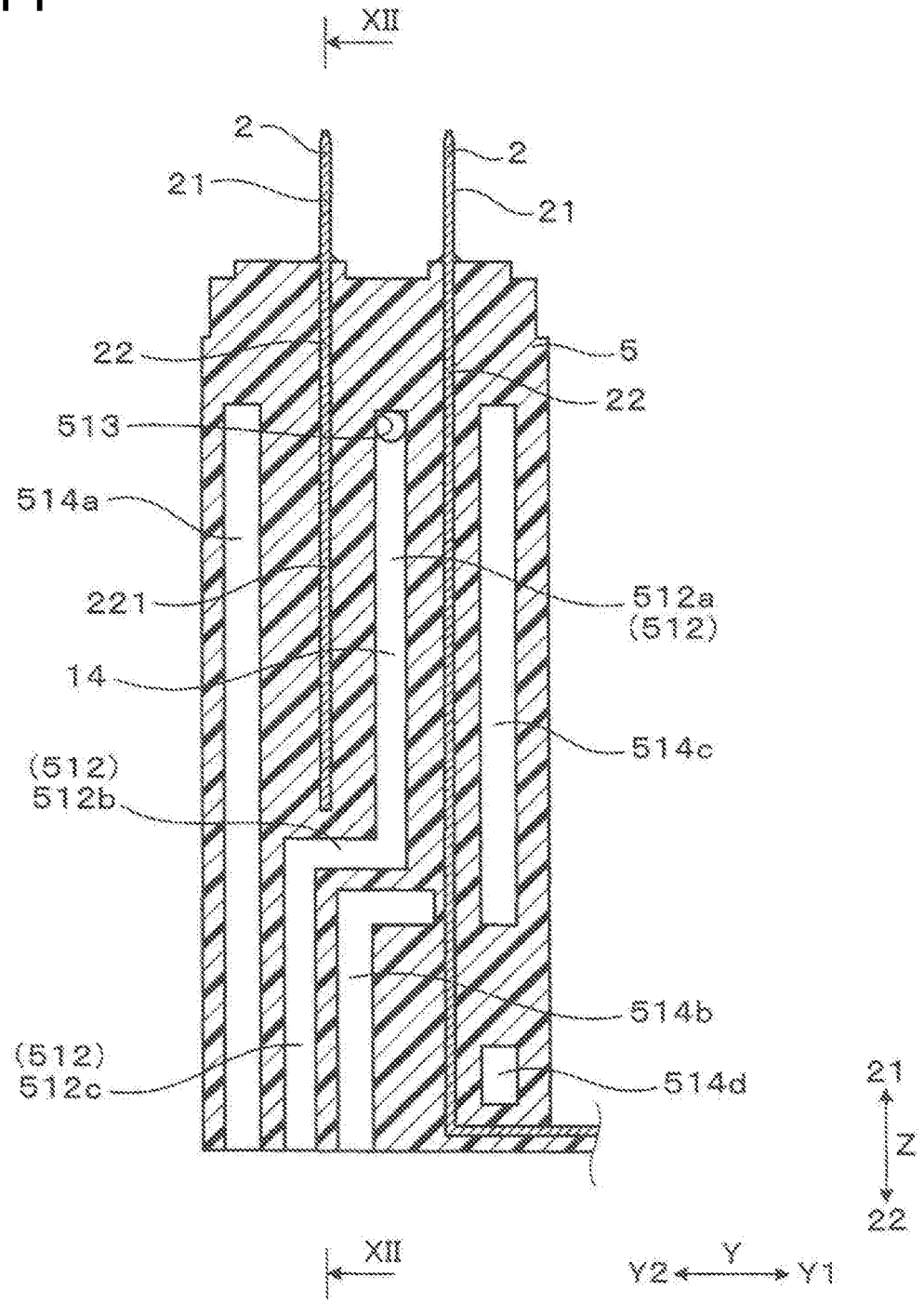
FIG. 11 is a section along XI-XI of FIG. 9.

As shown in FIG. 8, the tower groove 512 is formed by recessing a part of the first overlapping surface 511. As shown in FIGS. 5 and 6, the tower groove 512 is formed such that an inner space has a rectangular shape in a cross-section perpendicular to a formation direction thereof. As shown in FIGS. 10 and 11, the tower groove 512 is formed to be elongated in the Z direction.

The tower groove 512 has a crank shape bent in the first overlapping surface 511. The tower groove 512 includes an outer groove portion 512*a*, a coupling groove portion 512*b* and an inner groove portion 512*c*.

The outer groove portion 512*a* is elongated in the Z direction. As shown in FIG. 10, the outer groove portion 512*a* is located substantially at a center of the first overlapping surface 511 in a Y direction. The Y direction is a direction perpendicular to both the X direction and the Z direction.

As shown in FIGS. 10 and 11, the coupling groove portion 512*b* is formed in the Y direction from an end part of the outer groove portion 512*a* on the Z2 side toward one side in the Y direction. A length of the coupling groove portion 512*b* in the Y direction is shorter than a length of the outer groove portion 512*a* in the Z direction.

The inner groove portion 512*c* extends toward the Z2 side from an end part of the coupling groove portion 512*b* on a side opposite to the side communicating with the outer groove portion 512*a* in the Y direction. The inner groove portion 512*c* is elongated in the Z direction at a position offset in the Y direction with respect to the outer groove portion 512*a*. Further, the inner groove portion 512*c* is formed on a side of the ventilation path 14 closer to the internal space 13 of the case 11 than the outer groove portion 512*a*. The inner groove portion 512*c* is straight in the Z direction and a Z2 end part is open. A side of the outer groove portion 512*a* with respect to the inner groove portion 512*c* in the Y direction is referred to herein as a Y1 side and an opposite side thereof is referred to as a Y2 side.

As shown in FIG. 4, an open part of the Z2 end of the inner groove portion 512*c* communicates with the internal space 13 via a later-described second hole 621 in the second core 6 and a third hole 721 formed in the later-described third core 7. The second and third holes 621, 721 constitute a part of the ventilation path 14 together with the tower groove 512.

As shown in FIGS. 6, 9, 10 and 11, a through hole 513 is formed on the X1 side from a Z1 end of a bottom part of the outer groove portion 512*a* in the first tower 51. The through hole 513 penetrates through the first core tower 51 in the X direction. An inner space of the through hole 513 has a circular shape in a cross-section perpendicular to a longitudinal direction thereof (X direction). As shown in FIGS. 6 and 11, the through hole 513 passes through between the two first terminals 2. The first terminals 2 are not exposed in the through hole 513.

As shown in FIG. 6, a housing opening 810 of the housing 8 is formed on an X1 side of the through hole 513. The housing opening 810 opens the through hole 513 to outside air. The tower groove 512 communicates with outside air via the through hole 513 and the housing opening 810. The through hole 513, the housing opening 810 and the tower groove 512 constitute a part of the ventilation path 14.

As shown in FIGS. 10 and 11, the first overlapping surface 511 is formed with elongated recesses (first elongated recess 514*a*, second elongated recess 514*b*, third elongated recess 514*c* and fourth elongated recess 514*d*). As shown in FIG. 5, the elongated recesses are grooves into which later-described elongated projections formed on the second core 6 are inserted and fit.

The first elongated recess 514*a* is straight in the Z direction in the first overlapping surface 511 on a Y2 side of the entire tower groove 512. In the Z direction, the first elongated recess 514*a* is formed in the entire formation area of the tower groove 512 in the Z direction. A Z2 end of the first elongated recess 514*a* is open.

The second elongated recess 514*b* includes a part formed in the Y direction along the coupling groove portion 512*b* on a Z2 side of the coupling groove portion 512*b* of the tower groove 512 and a part formed in the Z direction along the inner groove portion 512*c* on a Y1 side of the inner groove portion 512*c* of the tower groove 512 and is L-shaped as a whole. The second elongated recess 514*b* is parallel to the coupling groove portion 512*b* and the inner groove portion 512*c*. A Z2 end part of the second elongated recess 514*b* is open on the Z2 side. The second elongated recess 514*b* is formed near the coupling groove portion 512*b* and the inner groove portion 512*c*.

The third elongated recess 514*c* is straight in the Z direction on a Y1 end of the first overlapping surface 511. The third elongated recess 514*c* is formed along the outer groove portion 512*a* on a Y1 side of the outer groove portion 512*a*. The third elongated recess 514*c* is closer to the Y1 side than the second elongated recess 514*b*. In the Z direction, the third elongated recess 514*c* is formed from a position on a Z1 end of the tower groove 512 to a position closer to the Z2 side than the position of a Z2 side end of the outer groove portion 512*a*. A Z2 side end of the third elongated recess 514*c* is formed at a position overlapping a Z1 side end part of the second elongated recess 514*b* in the Y direction.

The fourth elongated recess 514*d* is formed on a Z2 end of a Y2 side in the first overlapping surface 511 and is on the Z2 side of the third elongated recess 514*c*. As shown in FIGS. 8 to 10, the first base 52 is formed from a Z2 end of the first tower 51.

The first base 52 forms a plane perpendicular to the Z direction. The first base 52 is formed on the X1 side from the first tower 51 and projects farther toward the Y1 side than the first tower 51. Ends of the first terminals 2 on a side to be connected to the circuit board 12 project toward the Z2 side from a Y1 side of the first base 52.

[First Terminals 2]

As shown in FIG. 11, ends of the first terminals 2 define first projecting terminal portions 21 that project toward the Z1 side from a Z1 side end of the first tower 51. The first projecting terminal portions 21 of the first terminals 2 are arranged at a predetermined interval in the Y direction.

A part of the first terminal 2 embedded in the first tower 51 is referred to as a first tower terminal portion 22. The first terminal portion 22 on the Y1 side extends straight in the Z direction between the second elongated recess 514*b* and the third and fourth elongated recesses 514*c*, 514*d* in the Y direction.

Figure 12:
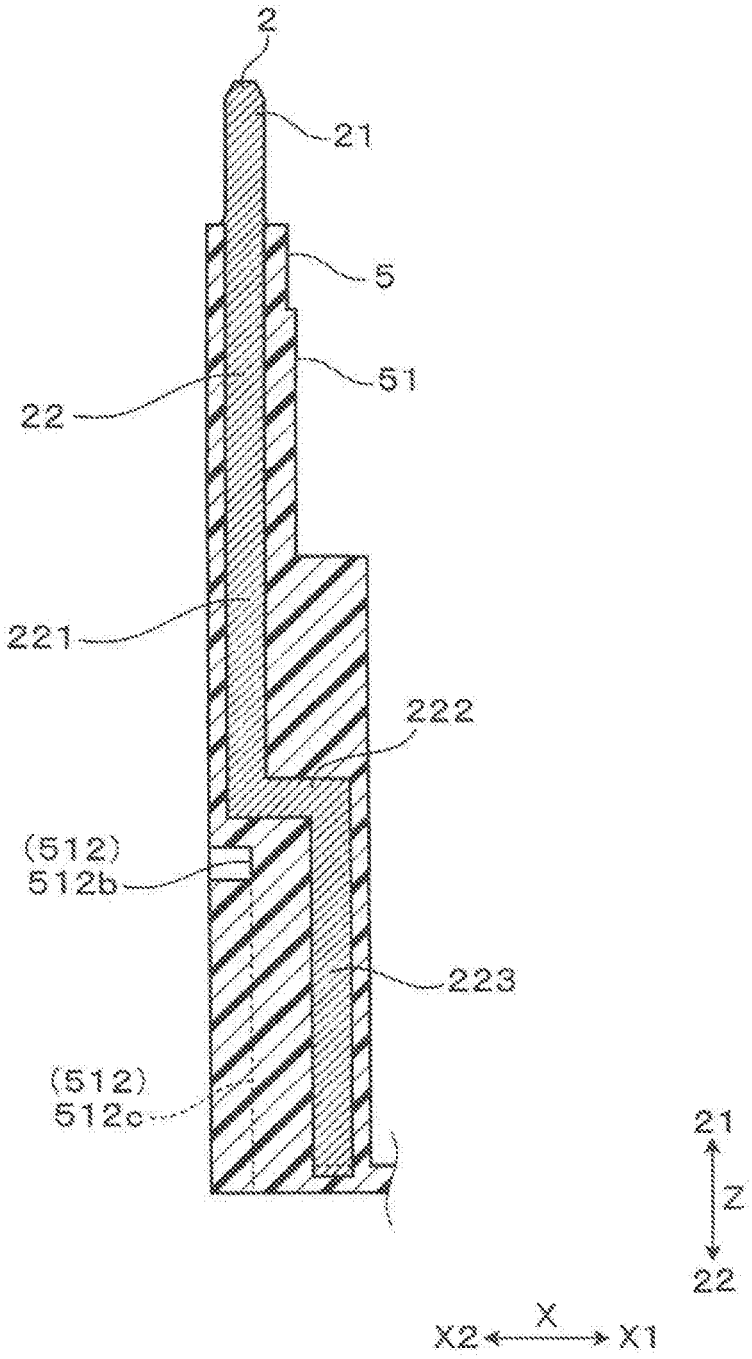
FIG. 12 is a section along XII-XII of FIG. 11.

As shown in FIG. 12, the first terminal portion 22 on the Y2 side has a crank shape bent in a plane perpendicular to the Y direction. Specifically, the first tower terminal portion 22 on the Y2 side includes a first tip tower terminal 221 formed on the Z2 side from the first projecting terminal portion 21, a first intermediate tower terminal 222 extending toward the X1 side from the first tip tower terminal 221 and a first base end tower terminal 223 extending from an X1 end of the first intermediate tower terminal 222 toward the Z2 side.

As shown in FIGS. 11 and 12, the first tip tower terminal 221 is at a position overlapping the coupling groove portion 512*b* in the Z direction. The first tip tower terminal 221 is formed from the first projecting terminal portion 21 to a position slightly closer to the Z1 side than the coupling groove portion 512*b* in the Z direction. As shown in FIG. 12, the first intermediate tower terminal 222 extends to a position closer to the X1 side than the tower groove 512. The first base end tower terminal 223 extends straight in the Z direction on the X1 side of the tower groove 512. As just described, at least one of the first terminals 2 is formed into a crank shape to avoid the tower groove 512.

[Second Core 6]

Figure 13:
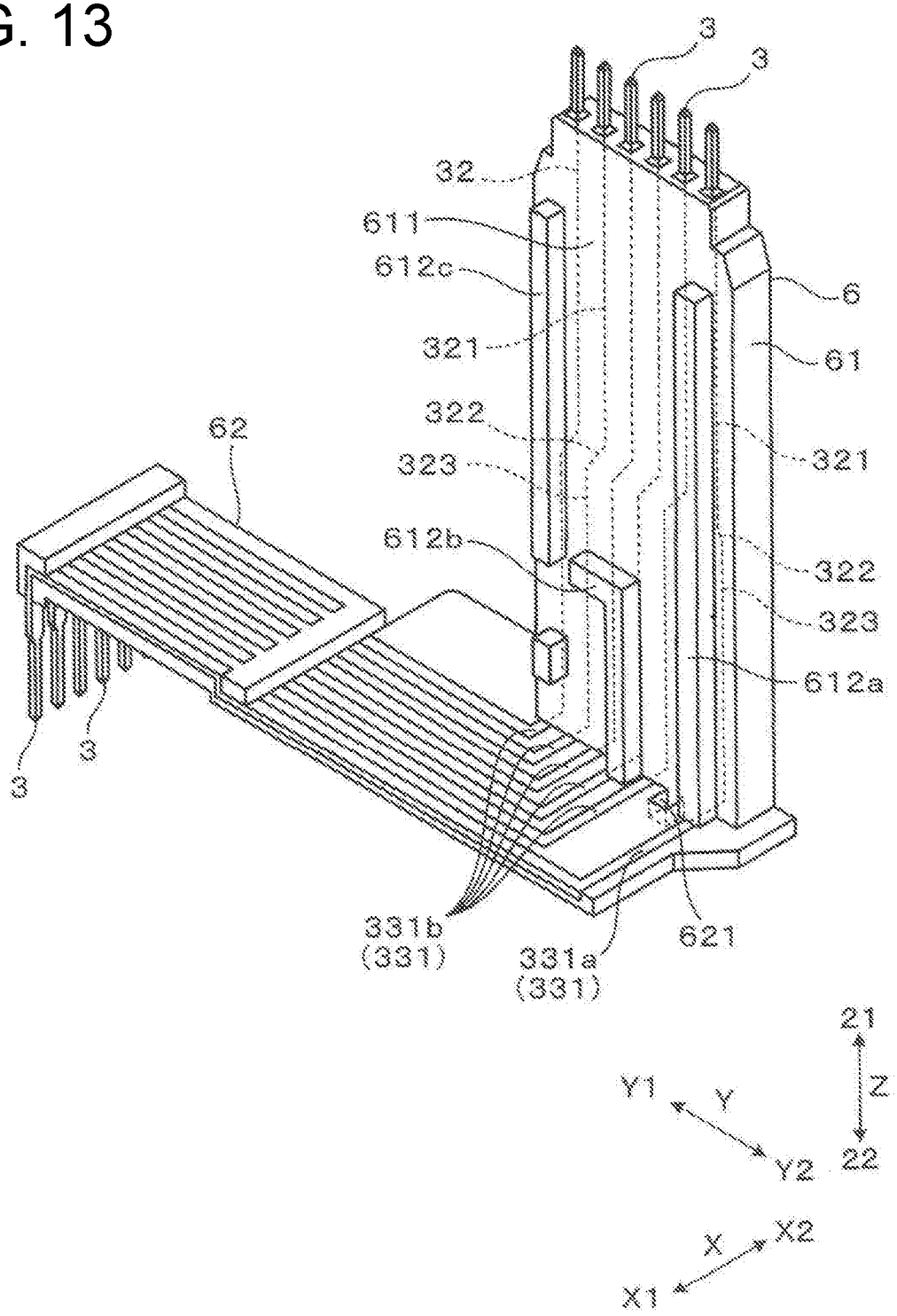
FIG. 13 is a perspective view of the second terminals and the second core in the first embodiment.

As shown in FIGS. 8, 9 and 13, the second core 6 holds six second terminals 3 that are arranged in parallel and at predetermined intervals.

The second core 6 includes a second base 62 formed in a plane direction parallel to the circuit board 12 and a second tower 61 projecting toward the Z1 side from the second base 62. As shown in FIGS. 7 to 9, the second core 6 is assembled with the first core 5 such that the second tower 61 is overlaps the first tower 51 on the X2 side and a part of the second base 62 overlaps the first base 52 on the Z2 side.

As shown in FIG. 13, the second tower 61 has a thickness in the X direction. A surface of the second tower 61 on the X1 side constitutes the second overlapping surface 611 to be overlapped on the first overlapping surface 511 of the first tower 51 of the first core 5.

The second overlapping surface 611 is perpendicular to the X direction. A projection area of the tower groove 512 of the first core 5 on the second overlapping surface 611 in the X direction is a flat surface perpendicular to the X direction. With the first and second cores 5, 6 overlapped, the second overlapping surface 611 closes the tower groove 512 from the X2 side to form a part of the ventilation path 14 between the tower groove 512 and the second overlapping surface 611.

As shown in FIG. 13, the second overlapping surface 611 is formed with first through fourth elongated projections 612*a*, 612*b*, 612*c* and 612*d*. As shown in FIGS. 4 and 5, the elongated projections 612*a*, 612*b*, 612*c* and 612*d* project from the second overlapping surface 611 toward a side where the first core 5 is disposed (X1 side).

The elongated projections project toward the elongated recesses of the first core 5 on the second overlapping surface 611 in the X direction. With the first and second cores 5, 6 overlapped, the first elongated projection 612*a* is inserted into the first elongated recess 514*a*, the second elongated projection 612*b* is inserted into the second elongated recess 514*b*, the third elongated projection 612*c* is inserted into the third elongated recess 514*c* and the fourth elongated projection 612*d* is inserted into the fourth elongated recess 514*d*.

As shown in FIG. 4, a part where the elongated projection and the elongated recess are fit is called a fitting portion 15. The fitting portions 15 include an outer fitting portion 15*a*, which is a part along the outer groove portion 512*a*, and an inner fitting portion 15*b*, which is a part along the inner groove portion 512*c*. The outer fitting portion 15*a* and the inner fitting portion 15*b* are located on the Y1 side of the tower groove 512. The outer fitting portion 15*a* is constituted by a part of the third elongated projection 612*c* and a part of the third elongated recess 514*c*, and the inner fitting portion 15*b* is constituted by a part of the second elongated projection 612*b* and a part of the second elongated recess 514*b*. The inner groove portion 512*c* is offset toward the Y2 side with respect to the outer groove portion 512*a*, as described above. Additionally, the inner fitting portion 15*b* offset toward the Y2 side with respect to the outer fitting portion 15*a*. In this way, both the inner fitting portion 15*b* and the outer fitting portion 15*a* easily are located near the bent tower groove 512.

In a cross-section perpendicular to the Z direction, the elongated projections have substantially the same shapes as the elongated recesses into which the elongated projections are fit. Specifically, the elongated projections are just fit into the elongated recesses. Note that, without limitation to this, the elongated projections may be somewhat larger than the elongated recesses in the cross-section perpendicular to the Z direction and are press-fit into the elongated recesses or are made slightly smaller than the elongated recesses. The second base 62 is formed toward the X1 side from a Z2 end of the second tower 61.

The second base 62 has a planar shape perpendicular to the Z direction. The second base 62 is formed on the X1 side from the second tower 61 and projects farther toward the Y1 side than the second tower 61. End parts of the second terminals 3 on a side to be connected to the circuit board 12 project toward the Z2 side from a Y1 end of the second base 62.

[Second Terminals 3]

Figure 14:
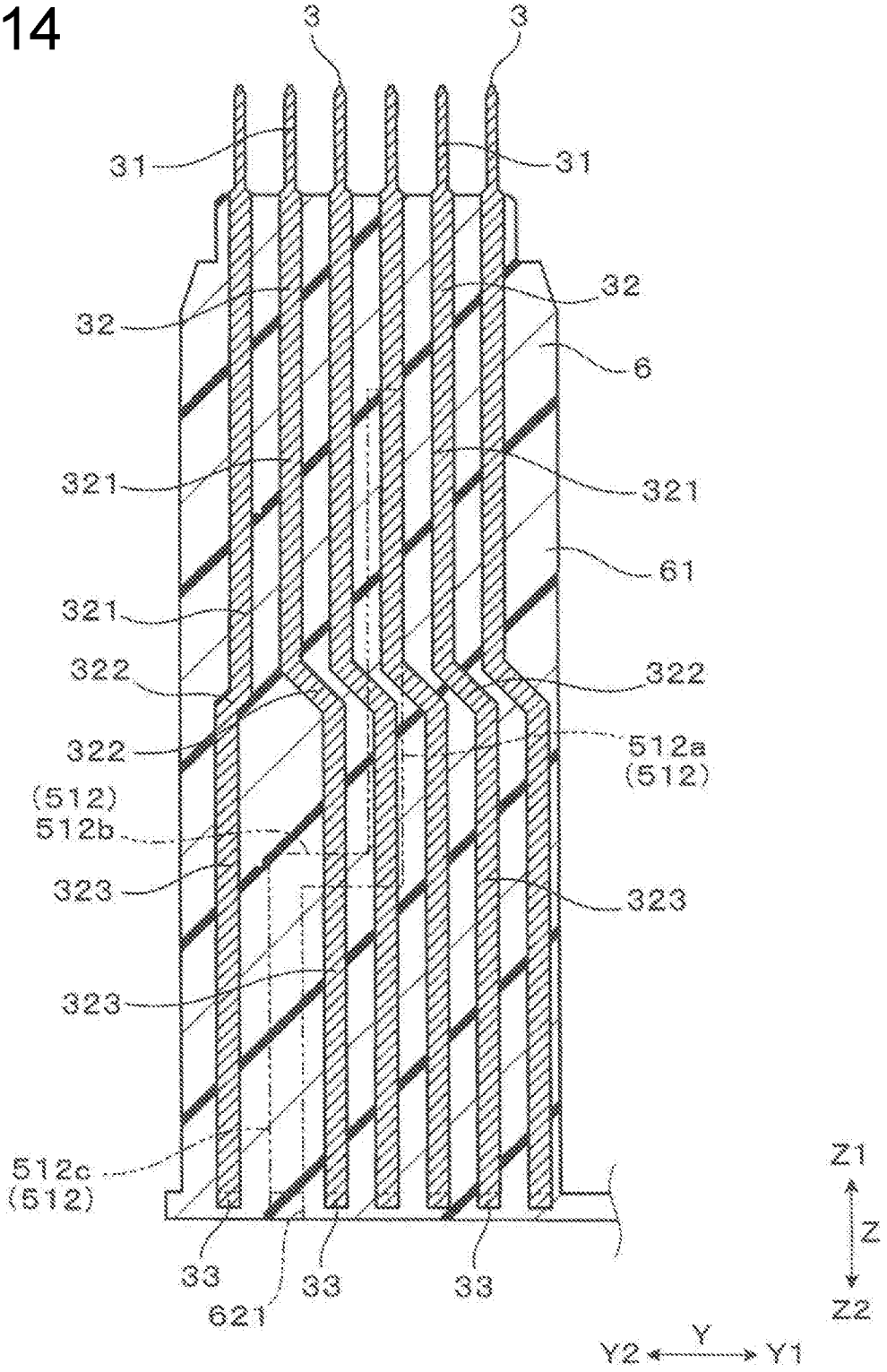
FIG. 14 is a section along XIV-XIV of FIG. 9.

As shown in FIGS. 13 and 14, the six second terminals 3 have second projecting terminal portions 31 that project from a Z1 end of the second tower 61 such that the second projecting terminal portions 31 are at equal intervals in the Y direction.

Parts of the six second terminals 3 embedded in the second tower 61 are referred to as second tower terminal portions 32. Each second tower terminal portion 32 is bent in a central part in the Z direction to define a crank shape. Specifically, the second tower terminal portion 32 includes a second tip tower terminal 321 formed on the Z2 side from the second projecting terminal portion 31, a second intermediate tower terminal 322 formed to be bent in the Y direction from the second tip tower terminal 321 and a second base end tower terminal 323 extending toward the Z2 side from an end part of the second intermediate tower terminal 322 on a side opposite to the second tip tower terminal 321.

The six second tip tower terminals 321 extend straight in the Z direction and are at equal intervals in the Y direction.

All of the six second intermediate tower terminals 322 except the second intermediate tower terminal 322 on a Y2 side are inclined to approach the Y1 side toward the Z2 side from the second tip tower terminals 321. On the other hand, the second intermediate tower terminal 322 on the Y2 side is inclined to approach the Y2 side toward the Z2 side from the second tip tower terminal 321. Specifically, out of the six intermediate tower terminals 322, the one disposed on the Y2 side is inclined away from the adjacent second intermediate tower terminal 322 toward the Z2 side.

The second base end tower terminals 323 are formed in the Z direction on the Z2 side from the second intermediate tower terminals 322. An interval in the Y direction between the second base end tower terminal 323 disposed on the Y2 side and the adjacent second base end tower terminal 323 is wider than intervals between the other second base end tower terminals 323.

Here, the contour of the tower groove 512 viewed from the X direction is shown in a two-dot chain line in FIG. 14. As shown in FIG. 14, the inner groove portion 512*c* of the tower groove 512 is in an area between the second base end tower terminal 323 on the Y2 side and the adjacent second base end tower terminal 323 in the Y direction.

As shown in FIG. 13, second base terminal portions 33 extend toward the X1 side from Z2 ends of the six second tower terminal portions 32. The second base terminal portions 33 are embedded in the second base 62 of the second core 6. Note that surfaces of parts of the second terminals 3 embedded in the second base 62 are partially exposed from the second base 62.

As shown in FIGS. 4, 9 and 13, six second base terminal portions 33 include six second specific terminal portions 331 formed in the X direction toward the X1 side from the second tower terminal portions 32 and are side by side in the Y direction.

The six second specific terminal portions 331 include a second separated terminal 331*a* disposed on the Y2 end and a second equal-interval terminal group 331*b* composed of five second specific terminal portions 331 disposed at equal intervals in the Y direction. An interval in the Y direction between the second separated terminal 331*a* and the second specific terminal portion 331 disposed closest to the second separated terminal 331*a* in the second equal-interval terminal group 331*b* is larger than the interval in the Y direction between the adjacent second specific terminal portions 331*a* of the second equal-interval terminal group 331*b*.

The second hole 621 is formed in a part between the second separated terminal 331*a* and the second equal-interval terminal group 331*b* in the second base 62 in the Y direction. That is, the second hole 621 is formed in the second base 62 to avoid the second terminals 3.

The second hole 621 penetrates through the second base 62 in the Z direction. As shown in FIG. 4, the second hole 621 overlaps an open part of the inner groove portion 512*c* of the tower groove 512 on the Z2 side and communicates with the inner groove portion 512*c* with the first and second cores 5, 6 overlapped. The size of the second hole 621 viewed from the Z direction is equal to that of the open part of the inner groove portion 512*c* on the Z2 side.

As shown in FIG. 4, the outer groove portion 512*a* of the tower groove 512 overlaps the second equal-interval terminal group 331*b* in the Z direction with the first and second cores 5, 6 overlapped. Thus, the second hole 621 cannot be formed in a part of the second base 62 overlapping the outer groove portion 512*a* in the Z direction. Therefore, in this embodiment, the tower groove 512 has a crank shape and communicates with the second hole 621 formed at the position deviated from the outer groove portion 512*a* in the Y direction.

[Third Core 7]

As shown in FIGS. 7 to 9, the third core 7 holds six third terminals 4 such that the third terminals 4 are parallel and are disposed at predetermined intervals that are maintained by the third core 7.

As shown in FIGS. 8 and 9, the third core 7 includes a third base 72 formed in a plane direction parallel to the circuit board 12 and a third tower 71 projecting toward the Z1 side from the third base 72. The third core 7 is assembled with the second core 6 such that the third tower 71 is overlapped on the X2 side of the second tower 61 and a part of the third base 72 is overlapped on the Z2 side of the second base 62.

The third tower 71 has a thickness in the X direction. A surface of the third tower 71 on the X1 overlaps a surface of the second tower 61 of the second core 6 on the X2 side. Each of the surface of the third tower 71 on the X1 side and the surface of the second tower 61 on the X2 side is perpendicular to the X direction.

As shown in FIG. 8, positioning projections 613 are formed on the surface of the second tower 61 on the X2 side and project toward the X2 side. Positioning recesses (not shown) are formed in the surface of the third tower 71 on the X1 side and are to be engaged with the positioning projections 613. With the second and third cores 6, 7 overlapped, the positioning projections 613 are fit into the positioning recesses so that a positional deviation between the second and third cores 6, 7 in a direction perpendicular to the X direction is prevented. The third base 72 is formed on the X1 side from a Z2 side end part of the third tower 71.

The third base 72 has a planar shape perpendicular to the Z direction. The third base 72 is formed on the X1 side from the third tower 71 and projects farther toward the Y1 side than the third core tower 71. Ends of the third terminals 4 on a side to be connected to the circuit board 12 project toward the Z2 side from a Y1 side of the third base 72.

[Third Terminals 4]

As shown in FIGS. 7 to 9, third projecting terminal portions 41, which are end parts of the six third terminals 4, project toward the Z1 side from a Z1 end of the third tower 71 and are arranged at equal intervals in the Y direction.

Parts of the six third terminals 4 embedded in the third tower 71 are shaped and configured similarly to the second tower terminal portions 32. As shown in FIG. 4, the third terminals 4 include six third specific terminal portions 42 formed in the X direction toward the X1 side from Z2 side end parts of parts of the third terminals 4 embedded in the third tower 71 and are formed side by side in the Y direction. The six third specific terminal portions 42 are configured similarly to the six second specific terminal portions 331.

Specifically, the six third specific terminal portions 42 include a third separated terminal 421 disposed on a Y2 side and a third equal-interval terminal group 422 composed of five third specific terminal portions 42 disposed at equal intervals in the Y direction. An interval in the Y direction between the third separated terminal 421 and the third specific terminal portion 42 disposed closest to the third separated terminal 421 in the third equal-interval terminal group 422 is larger than the interval in the Y direction between the adjacent third specific terminal portions 42 of the third equal-interval terminal group 422.

The third hole 721 is formed in a part between the third separated terminal 421 and the third equal-interval terminal group 422 in the third base 72 of the third core 7. That is, the third hole 721 is formed in the third base 72 to avoid the third terminals 4.

The third hole 721 penetrates through the third base 72 in the Z direction. The third hole 721 overlaps the open part of the inner groove portion 512*c* of the tower groove 512 on the Z2 side and the second hole 621 of the second core 6 in the Z direction and communicates with the inner groove portion 512*c* and the second hole 621 with the second and third cores 6, 7 overlapped. The size of the third hole 721 viewed from the Z direction is equal to that of the open part of the inner groove portion 512*c* on the Z2 side.

Each of the first, second and third cores 5, 6 and 7 is formed by insert molding by arranging the terminals in a mold for molding the core and injecting a resin material into the mold. As shown in FIG. 3, the housing 8 is formed to cover the first, second and third cores 5, 6 and 7.

[Housing 8]

The housing 8 is molded by insert molding using the first core 5 holding the first terminals 2, the second core 6 holding the second terminals 3 and the third core 7 holding the third terminals 4 as inserts.

As shown in FIG. 3, the housing 8 includes a housing tower 81 formed to cover the first tower 51 of the first core 5, the second tower 61 of the second core 6 and the third tower 71 of the third core 7 and elongated in the Z direction, and a housing base 82 formed into a planar shape perpendicular to the Z direction from the vicinity of a Z2 end of the housing tower 81.

Figure 2:
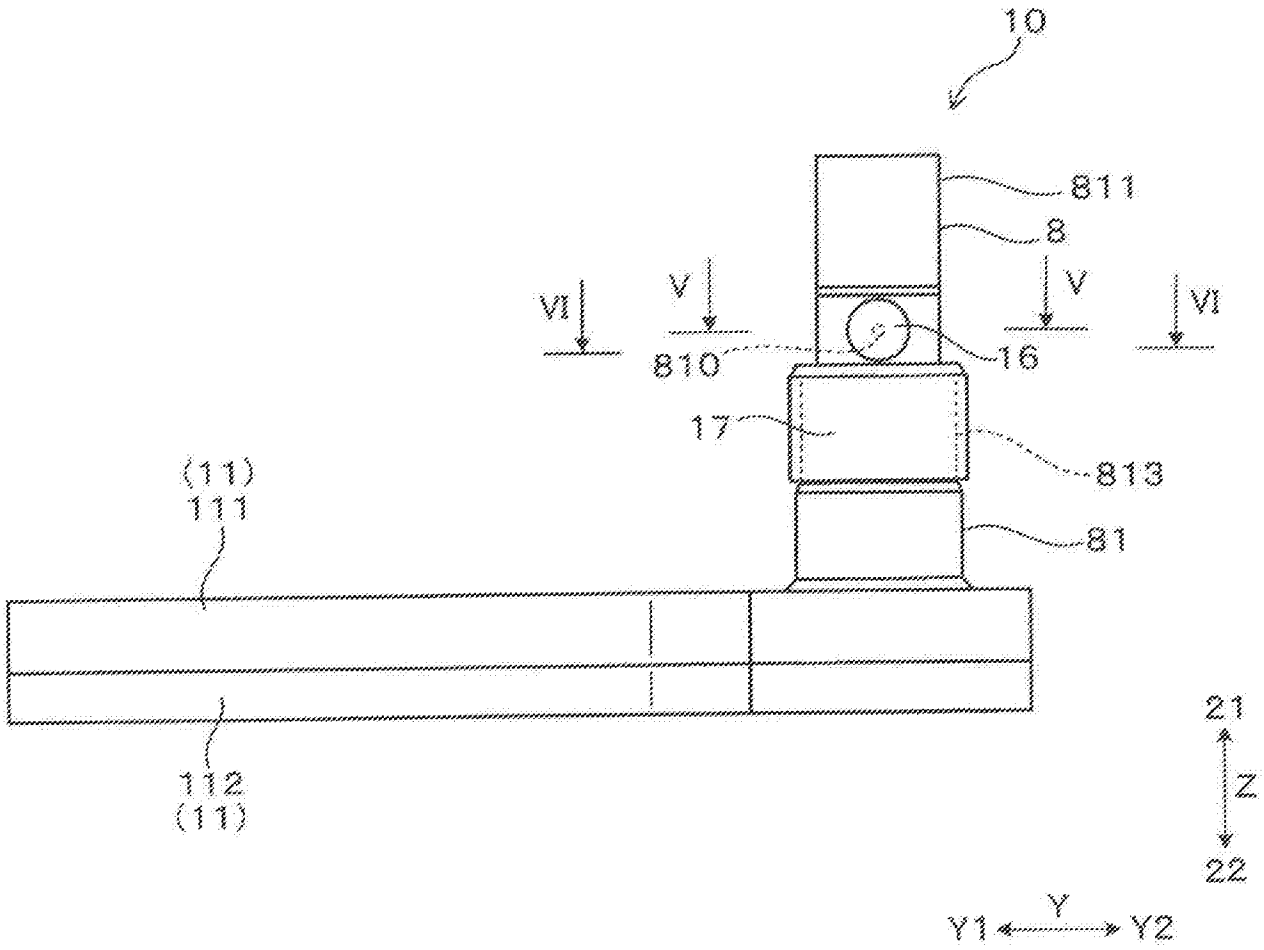
FIG. 2 is a side view of the control device with A connector in the first embodiment.
Figure 3:
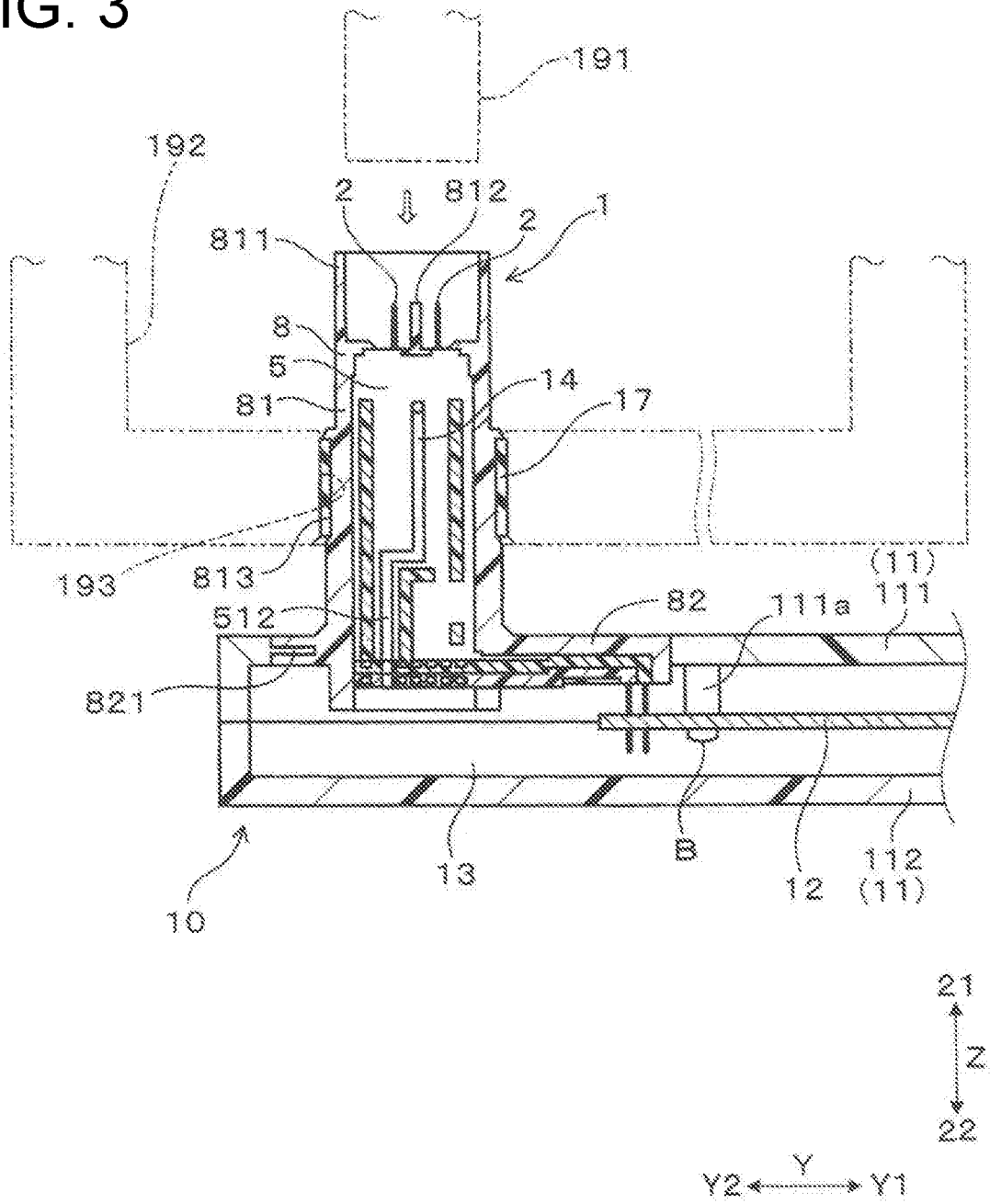
FIG. 3 is a section along III-III of FIG. 1.
Figure 4:
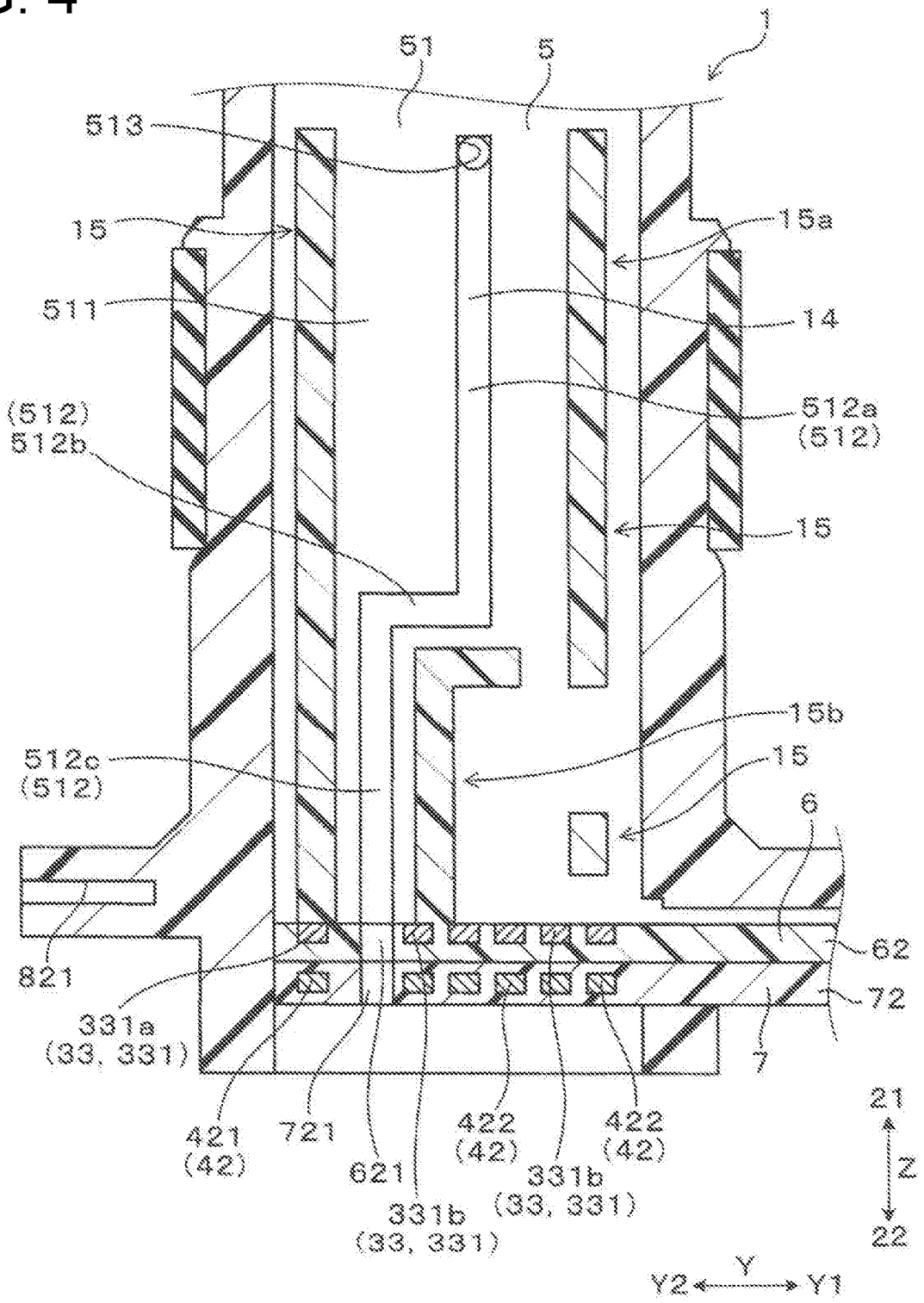
FIG. 4 is an enlarged section around a tower groove of FIG. 3.

As shown in FIGS. 1 to 3, the housing tower portion 81 includes a mounting portion 811 on a Z1 side end part. As shown in FIGS. 1 and 3, the mounting portion 811 surrounds one end part of each of the first, second and third terminals 2, 3 and 4, and the mating housing 191 is mounted inside. The mounting portion 811 has a tubular shape formed in the Z direction.

The housing 8 is formed with a separation wall 812 to ensure electrical insulation between the terminals exposed in the mounting portion 811. The separation wall 812 projects toward the Z1 side between the two first terminals 2 and between the first terminals 2 and the second terminals 3. A Z2 side of the mounting portion 811 is closed by a part of the housing 8 and the first, second and third cores 5, 6 and 7.

As shown in FIG. 2, the housing opening 810 is formed in a part of a side surface of the housing tower 81 near a Z2 side of the mounting portion 811. As described above, the housing opening 810 lets the through hole 513 of the first core 5 be open to outside air. As shown in FIG. 6, the housing opening 810 extends straight in the X direction, continuously with the through hole 513. The tower groove 512 does not directly communicate with a space inside the mounting portion 811.

As shown in FIGS. 2 and 6, a ventilation film 16 covering the housing opening 810 from the X1 side is disposed on the side surface of the housing tower 81. The ventilation film 16 is a filter that allows passage of gases while suppressing passage of liquids and solids. The ventilation film 16 can be a porous film, for example, made of fluororesin or polyolefin. Although the ventilation film 16 has a circular shape, there is no limitation to this.

As shown in FIGS. 2 and 3, the side surface of the housing tower 81 includes a seal arrangement recess 813 on the Z2 side of the housing opening 810. The seal arrangement recess 813 has a shape recessed toward an inner peripheral side over the entire circumference. An annular seal 17 is fit into the seal arrangement recess 813.

As shown in FIG. 3, the seal 17 seals between the connector 1 and, for example, a mating case 192 having the mating connector 191 mounted therein. Specifically, the housing tower 81 is inserted into a mating arrangement hole 193 formed in the mating case 192 and the seal 17 seals between the connector 1 and the mating arrangement hole 193 of the mating case 192.

A Z2 side end part of the housing tower 81 and the housing base 82 penetrate through a wall of a first case portion 111 and are held in close contact with this wall.

[Case]

As shown in FIGS. 2 and 3, the case 11 is formed by using unillustrated bolts to fasten first and second case portions 111 and 112 together in the Z direction so that the case 11 and the connector 1 form the internal space 13. The first case portion 111 is insert molded by arranging the connector 1 in a mold for molding the first case portion 111 and injecting resin into the mold so that the housing 8 is formed in close contact with the first case portion 111.

As shown in FIG. 3, the housing 8 includes an engaging recess 821 recessed toward the inner peripheral side in a part held in close contact with the first case portion 111. The first case portion 111 also enters the engaging recess 821. In this way, the housing 8 and the first case portion 111 are held in close contact with each other with improved strength. A bolt B fastens the circuit board 12 to a boss 111*a* provided in the first case portion 111.

The control device 10 with the connector 1 is disposed in oil filled in the automatic transmission. In a state where the mating connector 191 and the mating case 192 are assembled with the control device 10 as shown in FIG. 3, an area of the control device 10 closer to the Z2 side than the seal 17 is in an oil environment. However, an area closer to the Z1 side than the seal 17 is in an internal space of the mating case 192. Associated with this, the housing opening 810 disposed between the mounting portion 811 and the seal 17 in the Z direction is in the internal space of the mating case 192.

The internal space of the mating case 192 communicates with the atmosphere. In this way, the ventilation path 14 communicates with the atmosphere via the mating case 192 from the housing opening 810 with the control device 10 when the connector 1 is installed in the vehicle. The control device 10 is configured such that the internal space 13 of the case 11 is sealed with the ventilation path 14 closed.

[Functions and Effects]

Next, functions and effects of this embodiment are described.

The connector 1 of this embodiment has a bent shape in the overlapping surface. Thus, even if a straight tower groove would interfere with the first terminals 2 in the first core 5 or the second terminals 3 in the second core 6, the bent tower groove 512 can avoid such interference.

Further, the tower groove 512 includes the outer groove portion 512*a* that is elongated in the Z direction and the inner groove portion 512*c* that is elongated in a projecting direction at the position offset in the Y direction with respect to the outer groove portion 512*a* and formed on the side of the ventilation path 14 closer to the internal space 13 than the outer groove portion 512*a*. Therefore, even if the terminals or other obstacles are disposed in the first and second cores 5, 6 on an extension of the outer groove portion 512*a* in the Z direction, the ventilation path 14 can avoid these obstacles by offsetting the inner groove portion 512*c* in the Y direction with respect to the outer groove portion 512*a*.

Further, the second base terminal portions 33 are disposed on an extension of the outer groove portion 512*a* of the tower groove 512 in the Z direction. Thus, if the tower groove 512 is formed by directly extending the outer groove portion 512*a* in the Z direction, the ventilation path 14 may be closed by the second base terminal portions 33 or the second base terminal portions 33 may stand as an obstacle and it may not be possible to form the ventilation path 14. Accordingly, the second base 62 includes the second hole 621 formed at the position deviated from the second base terminal portions 33 in the plane direction and constituting a part of the ventilation path 14. The inner groove portion 512*c* of the tower groove 512 communicates with the second hole 621. Therefore, even if the second base terminal portions 33 are located on the extension of the outer groove portion 512*a* in the Z direction, the groove portion 512 and the second hole portion 621 can avoid the second base terminal portions 33.

The second base 62 includes the second hole 621 between the second base terminal portions 33. Thus, the space between the second base terminal portions 33 in the second base 62 can effectively be utilized as the ventilation path 14 to prevent enlargement of the entire connector 1.

Further, the second overlapping surface 611 of the second core 6 includes the elongated projections formed along the groove portion 512 on both sides of the location where the groove portion 512 is formed, and the first overlapping surface 511 of the first core 5 includes the elongated recesses to be fit to the elongated projections. Thus, the shapes of the contact surfaces of the elongated projections and the elongated recesses can be made complicated. Therefore, when the liquid resin is poured into the mold during the molding of the housing 8 with the first and second cores 5, 6 disposed in the mold for molding the housing 8 the liquid resin cannot close the ventilation path 14 through an interface between the first and second cores 5, 6.

Further, the inner fitting portion 15*b* along the inner groove portion 512*c* is offset toward the same side (Y2 side) as the inner groove portion 512*c* is offset with respect to the outer groove portion 512*a* with respect to the outer fitting portion 15*a* along the outer groove portion 512*a*. Thus, both the inner fitting portion 15*b* and the outer fitting portion 15*a* easily are located close to the tower groove 512. Therefore, even if the liquid resin, which will constitute the housing 8, intrudes into the interface between the first and second cores 5, 6 during the molding of the housing 8, the intrusion of the liquid resin can be stopped near the groove portion 512. Hence, the liquid resin cannot close the ventilation path 14 through the interface between the first and second cores 5, 6.

As described above, according to this embodiment, a connector with a properly configured groove is formed easily.

Second Embodiment

Figure 15:
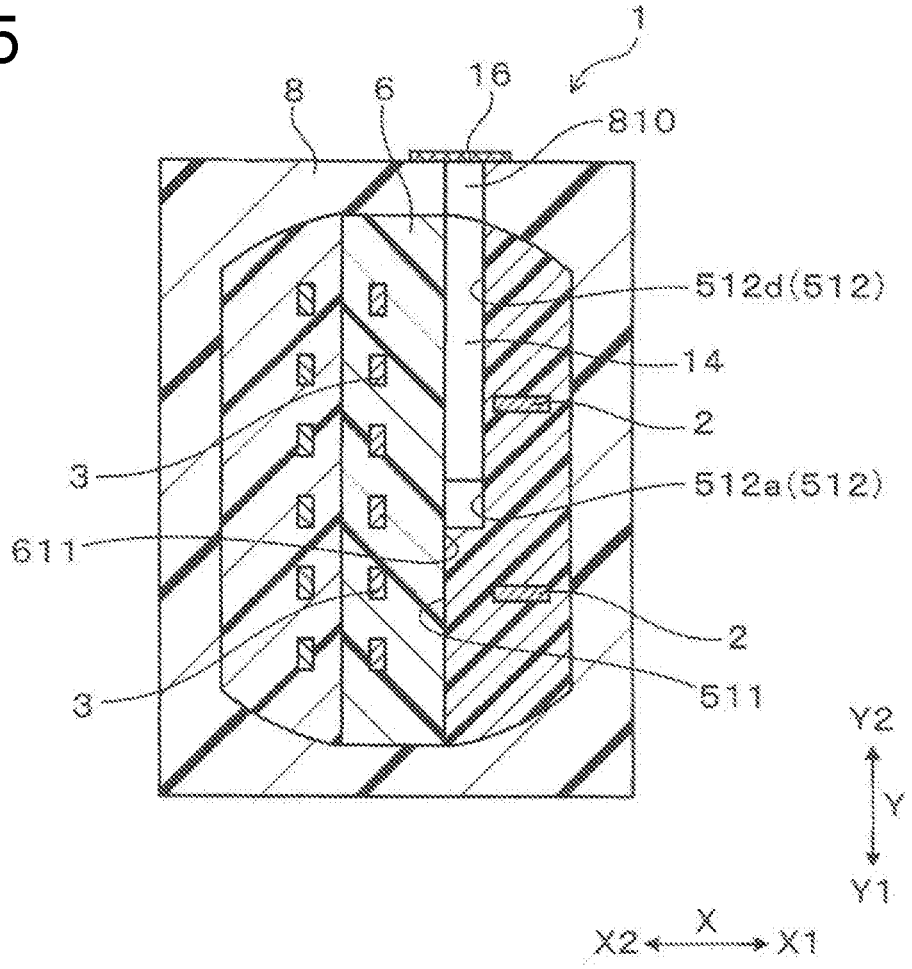
FIG. 15 is a section along an extended groove of a connector in a second embodiment.
Figure 16:
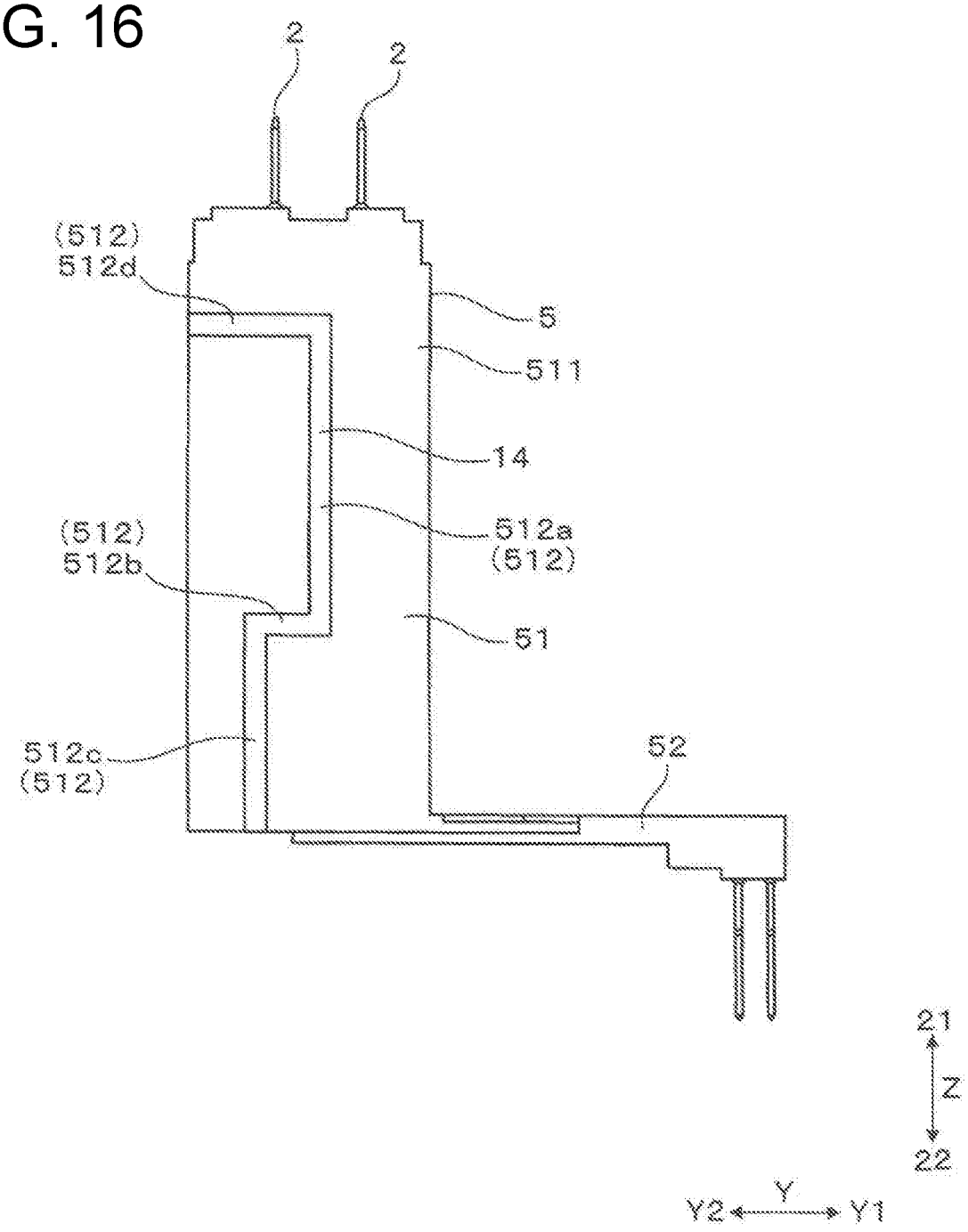
FIG. 16 is a view of first terminals and a first core viewed from the side of a second core in the second embodiment.
Figure 17:
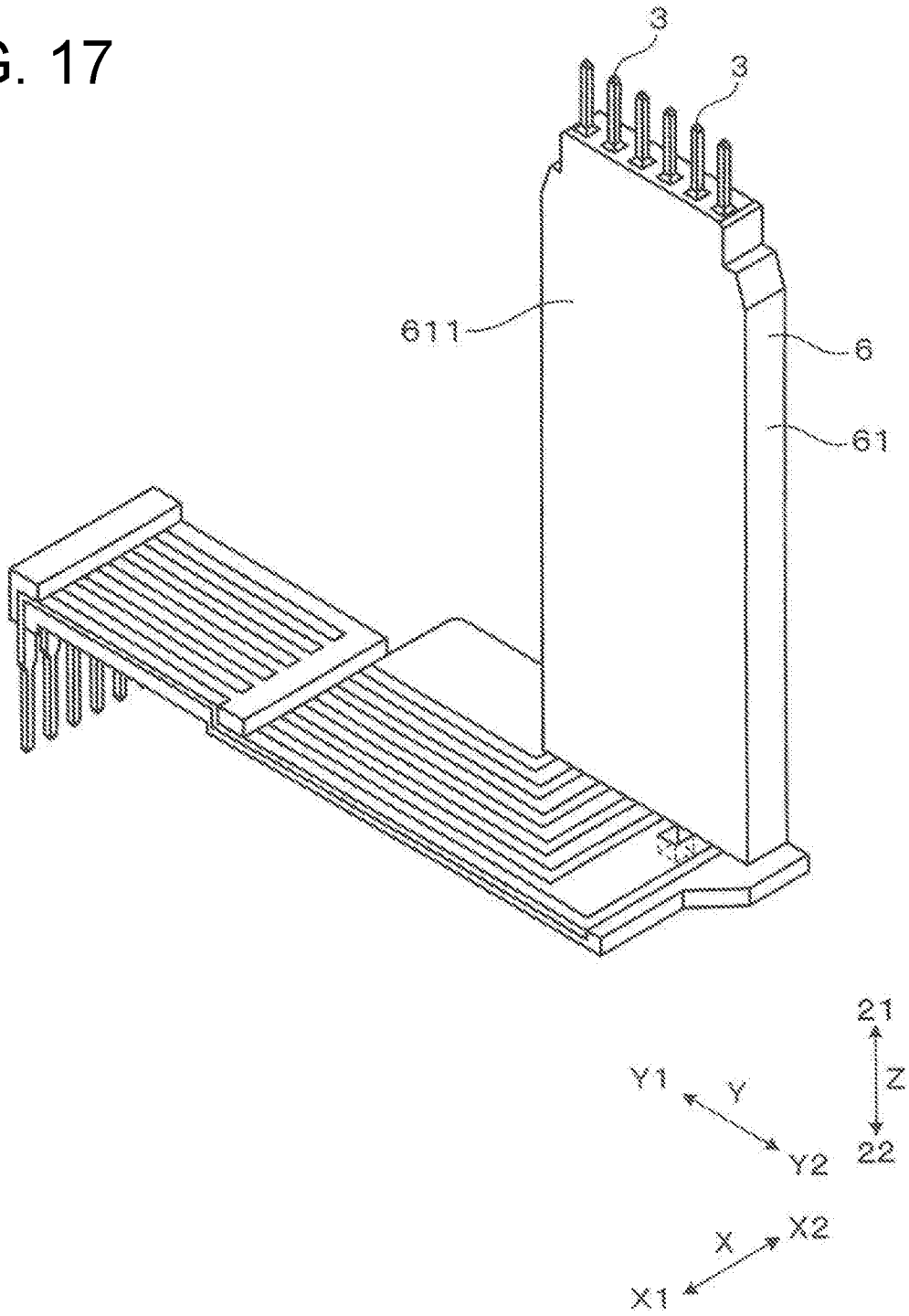
FIG. 17 is a perspective view of second terminals and the second core in the second embodiment.

A second embodiment differs from the first embodiment in a part of a ventilation path 14, as shown in FIGS. 15 to 17.

As shown in FIGS. 15 and 16, a tower groove 512 includes an extended groove portion 512*d* extending toward a Y2 side from a Z1 end of an outer groove portion 512*a*. An end part of the extended groove portion 512*d* on a side opposite to the outer groove portion 512*a* (i.e. Y2 side end part) is open toward the Y2 side.

As shown in FIG. 17, a second overlapping surface 611 of a second core tower 61 of a second core 6 is formed into a flat surface perpendicular to an X direction. As shown in FIG. 15, a part of the ventilation path 14 is formed between the tower groove 512 including the extended groove portion 512*d* and the second overlapping surface 611 with a first core 5 and the second core 6 overlapped.

As shown in FIG. 15, a housing opening 810 is formed on a Y2 side of the extended groove portion 512*d* to communicate with a Y2 end of the extended groove portion 512*d*.

Note that, in this embodiment, the first core 5 does not include the through hole (see reference sign 513 of FIGS. 4, 6) shown in the first embodiment. Further, in this embodiment, the first overlapping surface 511 and the second overlapping surface 611 do not include the elongated recesses and the elongated projections shown in the first embodiment.

The other configuration is the same as in the first embodiment.

Note that, reference signs used in the second and subsequent embodiments, the same reference signs as those used in the previous embodiment represent constituent elements similar to those of the previous embodiment unless otherwise specified.

In this embodiment, to constitute the ventilation path 14, it is sufficient to form only the groove 512 in the first core 5. Therefore, the shape of the first core 5 is simplified.

Other functions and effects are similar to those of the first embodiment.

Third Embodiment

Figure 18:
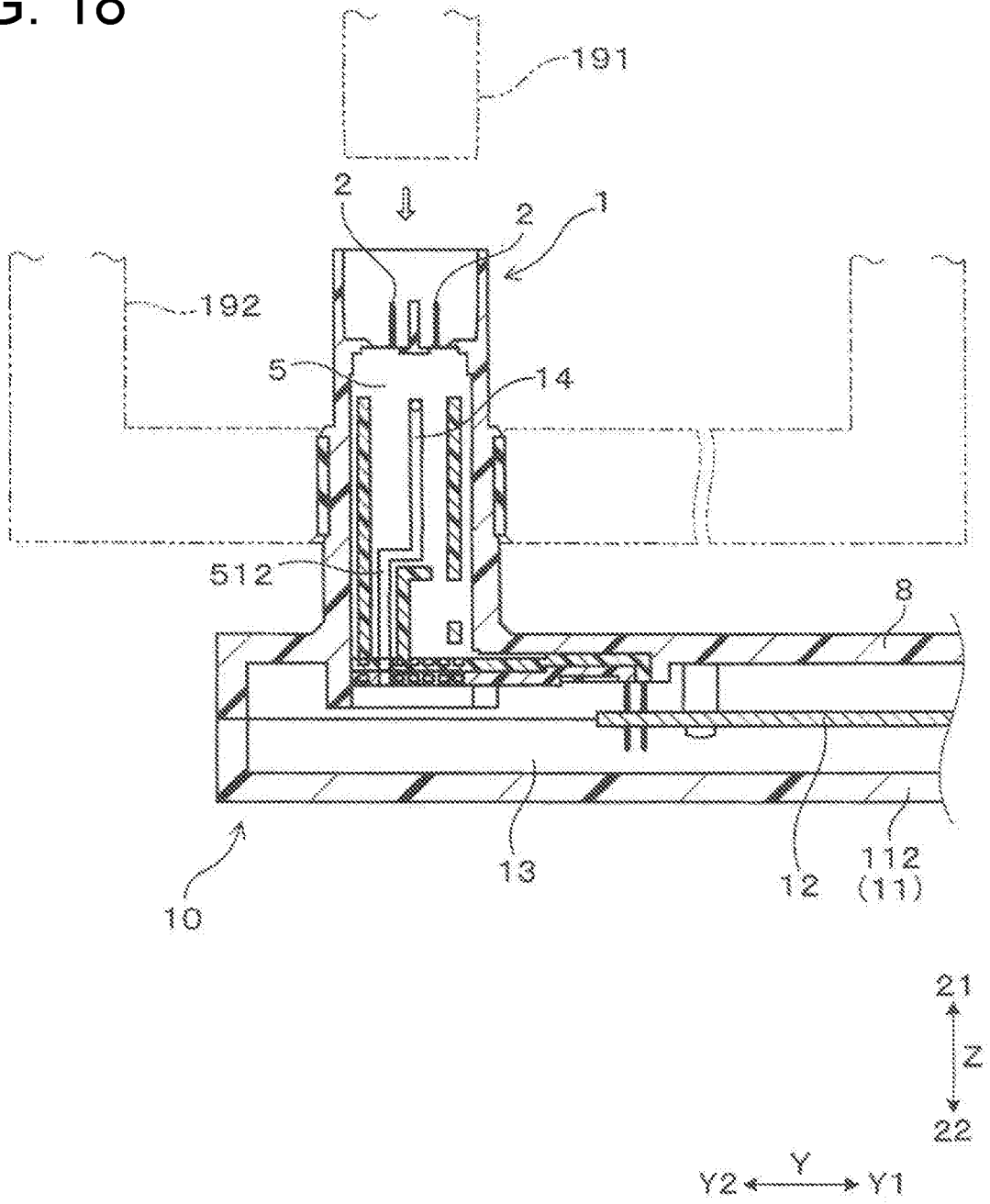
FIG. 18 is a section, corresponding to FIG. 3, of a connector in a third embodiment.

In a third embodiment, a part equivalent to the first case portion (see reference sign 111 of FIGS. 1 to 3 and the like) described in the first embodiment is constituted by a housing 8, as shown in FIG. 18.

In this embodiment, a connector 1 forms an internal space 13 for accommodating a circuit board 12 together with a second case 112 serving as a case 11.

The other configuration is the same as in the first embodiment.

Since a part of the housing 8 has a function as a case in this embodiment, the number of components is easily reduced.

Other functions and effects are similar to those of the first embodiment.

The invention is not limited to each of the above embodiments and can be applied to various embodiments without departing from the scope defined by the claims.

LIST OF REFERENCE SIGNS

1 connector
10 control device
11 case
111 first case
111*a* boss
112 second case
12 circuit board
13 internal space
14 ventilation path
15 fitting portion
15*a* outer fitting portion
15*b* inner fitting portion
16 ventilation film
17 seal
191 mating connector
192 mating case
193 mating arrangement hole
2 first terminal
21 first projecting terminal portion
22 first tower terminal portion
221 first tip tower terminal
222 first intermediate tower terminal
223 first base end tower terminal
3 second terminal
31 second projecting terminal portion
32 second tower terminal portion
321 second tip tower terminal
322 second intermediate tower terminal
323 second base end tower terminal
33 second base terminal portion
331 second specific terminal portion
331*a* second separated terminal
331*b* second equal-interval terminal group
4 third terminal
41 third projecting terminal portion
42 third specific terminal portion
421 third separated terminal
422 third equal-interval terminal group
5 first core
51 first tower
511 first overlapping surface
512 groove portion (tower groove)
512*a* outer groove portion
512*b* coupling groove portion
512*c* inner groove portion
512*d* extended groove portion
513 through hole
514*a* first elongated recess
514*b* second elongated recess
514*c* third elongated recess
514*d* fourth elongated recess
52 first base
6 second core
61 second tower
611 second overlapping surface
612*a* first elongated projection
612*b* second elongated projection
612*c* third elongated projection
612*d* fourth elongated projection
613 positioning projection
262 second base
621 second hole portion
7 third core
71 third tower
72 third base
721 third hole portion
8 housing
81 housing tower
810 housing opening
811 mounting portion
812 separation wall
813 seal arrangement recess
82 housing base
821 engaging recess
B bolt

What is claimed is:

1. A connector forming an internal space for accommodating a circuit board together with a case, comprising:
first terminals;
a first core holding the first terminals while exposing both end parts of the first terminals;
second terminals;
a second core facing and overlapping the first core, the second core holding the second terminals while exposing both end parts of the second terminals;
a housing covering at least a part of the first core and at least a part of the second core; and
a ventilation path allowing the internal space to communicate with outside air,
wherein:
at least a part of the ventilation path is constituted by a groove formed in at least one of overlapping surfaces of the first core and the second core overlapping each other, and the groove including:
a first groove portion having a first inner end communicating with the inner space, and a first outer end,
a second groove portion having a second inner end spaced from the first outer end of the first groove portion and a second outer end communicating with the outside air, and
a coupling groove portion extending angularly between the first outer end of the first groove portion and the second inner end of the second groove portion so that the groove has a bent shape in the overlapping surface to avoid interference with the first and second terminals.

2. The connector of claim 1, wherein the first groove portion and the second groove portion are substantially parallel to one another.

3. The connector of claim 1, wherein the coupling groove portion is substantially perpendicular to the first groove portion and the second groove portion.

4. A connector forming an internal space for accommodating a circuit board together with a case, comprising:
first terminals;
a first core holding the first terminals while exposing both end parts of the first terminals;
second terminals;
a second core facing and overlapping the first core, the second core holding the second terminals while exposing both end parts of the second terminals;
a housing covering at least a part of the first core and at least a part of the second core; and
a ventilation path allowing the internal space to communicate with outside air, wherein:

at least a part of the ventilation path is constituted by a groove formed in at least one of overlapping surfaces of the first core and the second core overlapping each other, each of the first core and the second core includes a base formed in a plane direction parallel to the circuit board and a tower projecting from the base toward a side opposite to the internal space, the groove includes a tower groove formed in the tower, and the tower groove includes an outer groove portion elongated in a projecting direction of the tower core portion from the base, an inner groove portion elongated in the projecting direction at a position offset in a lateral direction perpendicular to the projecting direction with respect to the outer groove portion and formed on a side of the ventilation path closer to the internal space than the outer groove portion, and a coupling groove portion coupling the outer groove portion and the inner groove portion so that the grove has a bent shape in the overlapping surface.

5. The connector of claim 4, wherein:

at least either the first terminals or the second terminals include base terminal portions embedded in the base, the base includes a hole formed at a position deviated from the base terminal portions in the plane direction and constituting a part of the ventilation path, the base terminal portions are disposed on an extension of the outer groove portion of the tower groove in the projecting direction, and the inner groove portion of the tower groove communicates with the hole.

6. The connector of claim 5, wherein the base includes the hole between the base terminal portions.

7. The connector of claim 6, wherein:

the overlapping surface of the first core and the overlapping surface of the second core include a fitting portion formed by fitting an elongated projection formed on one of the overlapping surfaces into an elongated recess formed in the other overlapping surface, the fitting portion includes an outer fitting portion along the outer groove portion and an inner fitting portion along the inner groove portion on one side of the tower groove in the lateral direction, and the inner fitting portion is offset toward the same side as the inner groove portion is offset with respect to the outer groove portion on one side in the lateral direction with respect to the outer fitting portion.

* * * * *